US007401536B2

(12) United States Patent
Englert et al.

(10) Patent No.: US 7,401,536 B2
(45) Date of Patent: Jul. 22, 2008

(54) METHOD OR JOINTING THE CUTTING EDGE OF AT LEAST ONE CUTTING BLADE OF A ROTATING TOOL

(75) Inventors: Heinrich Englert, Lauda-Königshofen (DE); Albrecht Dawidziak, Grossrinderfeld (DE)

(73) Assignee: Michael Weinig Aktiengesellschaft, Tauberbischofsheim (DE)

( * ) Notice: Subject to any disclaimer, the term of this patent is extended or adjusted under 35 U.S.C. 154(b) by 0 days.

(21) Appl. No.: 10/073,668

(22) Filed: Feb. 8, 2002

(65) Prior Publication Data

US 2002/0152855 A1 Oct. 24, 2002

(30) Foreign Application Priority Data

Feb. 9, 2001 (DE) ..... 101 06 014

(51) Int. Cl.
*B26B 19/00* (2006.01)

(52) U.S. Cl. ..... 76/115; 76/85; 451/419

(58) Field of Classification Search ..... 76/50, 76/50.4, 115, 85, 82.1; 451/419; 144/130.2; 83/174, 174.1
See application file for complete search history.

(56) References Cited

U.S. PATENT DOCUMENTS 563,105 A * 6/1896 Vivarttas ..... 144/130.2 X
874,355 A * 12/1907 Blood et al. ..... 144/130.2
985,473 A * 2/1911 Thomas ..... 451/419
993,367 A * 5/1911 Harper ..... 144/130.2 X
993,398 A * 5/1911 Osborn ..... 144/130.2
1,136,594 A * 4/1915 Fosterling ..... 144/130.2
1,531,350 A * 3/1925 Sloan ..... 76/31
1,651,013 A * 11/1927 Buss et al. ..... 144/130.2 X
1,804,439 A * 5/1931 Shanton ..... 76/82.1
2,574,499 A * 11/1951 Ruscitti et al. ..... 76/41
2,688,888 A * 9/1954 Whitworth et al. ..... 76/82.1
2,864,210 A 12/1958 Mann ..... 451/419
4,581,856 A * 4/1986 Theien ..... 144/130.2 X
4,739,588 A * 4/1988 Engh ..... 451/419
5,727,991 A * 3/1998 Main ..... 451/419 X

FOREIGN PATENT DOCUMENTS

DE 39 27 230 3/1990

* cited by examiner

*Primary Examiner*—Ken Peterson
(74) *Attorney, Agent, or Firm*—Gudrun E. Huckett

(57) ABSTRACT

In a method of jointing a cutting edge of at least one cutting blade of a rotating tool, wherein between the tool and at least one straight jointing stone a radial advancing movement is carried out and wherein the jointing stone has an active jointing area that is longer than a length of the cutting edge, at least one relative stroke between the jointing stone and the cutting edge is performing during jointing in a longitudinal direction of the cutting edge. The relative stroke has a stroke length that is shorter than the length of the cutting edge.

4 Claims, 4 Drawing Sheets

METHOD OR JOINTING THE CUTTING EDGE OF AT LEAST ONE CUTTING BLADE OF A ROTATING TOOL

BACKGROUND OF THE INVENTION

1. Field of the Invention

The invention relates to a method for jointing the cutting edge of at least one cutting blade of a rotating tool wherein a radial advancing movement is carried out between the tool and at least one straight jointing stone whose effective joint area is longer than the cutting edge.

2. Description of the Related Art

When peripherally milling workpieces, a groove pattern comprised of grooves having a certain spacing between neighboring grooves is generated on the workpiece surface. The groove pattern depends on the machining parameters such as rotational speed of the tool, number of cutting edges of the tool, and the advancing speed of the tool. The spacing of neighboring grooves is an essential quality criterion for the surface of the workpiece. A high-quality workpiece surface is characterized by a uniform groove pattern whose groove spacing is between approximately 1 mm and 2 mm.

When employing conventional tools and conventional tool clamping systems, only one cutting edge will be imprinted on the workpiece surface as a result of the tolerances with respect to the cutting circle of the different cutting edges of the tool and the concentricity of the clamped tool. The cutting circle is the circle described by the rotating cutting edges, respectively. In this way, the achievable advancing speed of the tool for a high-quality milling action depends only on the rotational speed of the tool and, like the rotational speed of the tool, is thus limited by the configuration or construction of the tool. In practice, workpiece advancing speeds of approximately 20 m/min. result.

In order to be able to achieve higher advancing speeds (for example, >20 m/min) which are proportional to the number of cutting edges of the tool, all of the cutting edges of the cutting blades of the tool must imprint uniformly on the surface of the workpiece to be machined. In order to achieve this, the cutting edges of the cutting blades are jointed within the machine, i.e., the cutting edges, when the tool is rotating, are adjusted to be positioned on a uniform cutting circle of the rotating edges by advancing a jointing stone and subjected to whetting or grinding. A prerequisite for this is that the tools themselves are already very precisely ground to run true and that the tool clamping system has only minimal tolerances with respect to concentricity. In practice, the tools are centrally clamped by means of hydraulic clamping systems for this purpose. Also, the tools are clamped with cone clamping systems (positive taper lock system).

When carrying out jointing, the cutting edge of the cutting blade is radially ground, i.e., at a clearance angle of 0°. However, this is possible only to a certain degree because otherwise the cutting edge would perform a pushing action and thus reduce the machining quality. In practice, so-called jointing bezel widths of a maximum of 0.7 mm are permissible. In order to be able to carry out as many jointing processes before reaching this maximum jointing bezel width, the aforementioned conditions must be provided. Otherwise, a great portion of the possible jointing bezel width will already be used during the first jointing process with which initially the cutting edges of all cutting blades of the tool are aligned on a uniform cutting circle.

After grinding and insertion of the tools with the clamped cutting blades for the first jointing process, the jointing stone is radially advanced step-by-step until all cutting blades are brought into contact with the jointing stone, i.e., all cutting blades are jointed. Subsequently, approximately 1.5 mm to 2/100 mm advancing strokes are radially performed for each jointing process. When the maximum jointing bezel width has been reached, the tools with the clamped cutting blades are removed from the machine and the cutting blades are then finish-ground in a grinding machine.

A principal distinction is made between straight jointing and profile jointing. In the case of straight jointing (FIG. 6) of straight non-profiled cutting blades 3, a jointing stone 31 in the form of a pin is radially advanced and subsequently moved axis-parallel in order to joint the cutting edges 9 of the cutting blades 3 across their entire length. A disadvantage is that relatively small jointing stones 31 will wear relatively quickly and, in an extreme situation, the jointing result will be a conically tapering cutting blade 3.

When profile jointing, the jointing stone is provided with the negative contour of the cutting edge of the cutting blade and is advanced only in a radial direction.

In the case of straight jointing, it is also known to employ a straight jointing stone whose length is somewhat greater than the jointing cutting edge of the cutting blade. This jointing stone is advanced only radially. A disadvantage of this straight jointing process is that, for example, a nick or notch within the jointing stone will be directly transmitted onto the cutting edge of the cutting blade and will cause marks on the cutting edge. This disadvantage must be accepted for profile jointing; however, in this application, the effect is not as strong because of the already profiled cutting edge configuration.

As a result of the different type of action, the straight and profile jointing devices are configured constructively differently and are either mounted alternatively correlated with the respective spindle of the machine or, depending on the tool, are employed alternatively.

SUMMARY OF THE INVENTION

It is an object of the present invention to configure the method according to the invention such that the cutting edges can be optimally jointed with minimal wear of the jointing stone.

In accordance with the present invention, this is achieved in that at least one relative stroke, which is smaller than the length of the cutting edge, is carried out between the jointing stone and the cutting edge during the jointing process in the longitudinal direction of the cutting edge.

In the method according to the invention, an axial relative movement between the jointing stone and the cutting edge is performed during the jointing process at least in one longitudinal direction of the cutting edge. This stroke is smaller than the length of the cutting edge, preferably smaller by a multiple. By means of this stroke movement, the groove formation on the cutting edge of the cutting blade is reliably prevented. Moreover, the wear of the jointing stone is minimal because a very large surface area of the jointing stone is always engaged. By means of the method according to the invention, a microscopically smooth cutting edge is provided which results in a high surface quality of the workpiece machined therewith.

DESCRIPTION OF THE PREFERRED EMBODIMENTS

Figure 2:
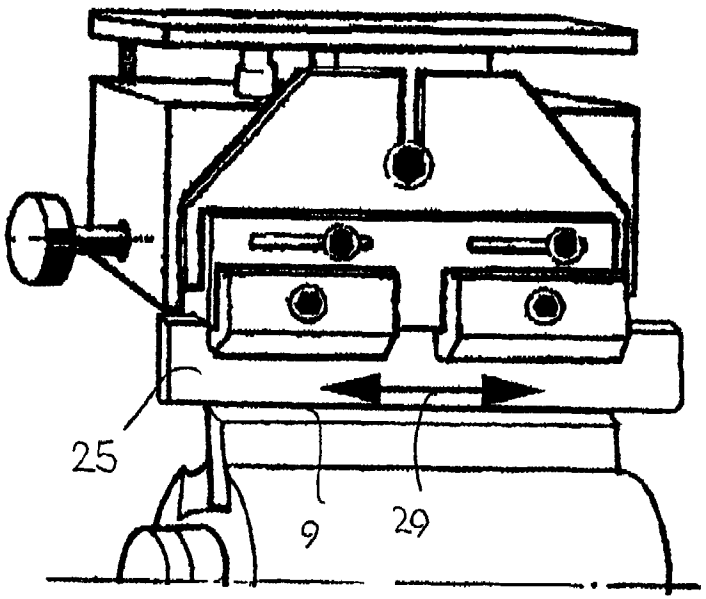
FIG. 2 is a perspective and simplified illustration of the jointing device in a second position of the jointing process.

In particular in the case of woodworking machines, blade heads are used which have cutting blades arranged about the circumference of the head for machining wood materials. In order to be able to reach a high machining quality, the cutting edges of the cutting blades must be positioned on a uniform cutting edge circle. In order to achieve this, the cutting edges of the rotating blade head are jointed by means of at least one jointing stone. By means of the jointing stone, the cutting edges of the different cutting blades are adjusted to a uniform cutting circle. The invention will be explained in the following in connection with the accompanying drawings where like reference numerals refer to like parts.

Figure 1:
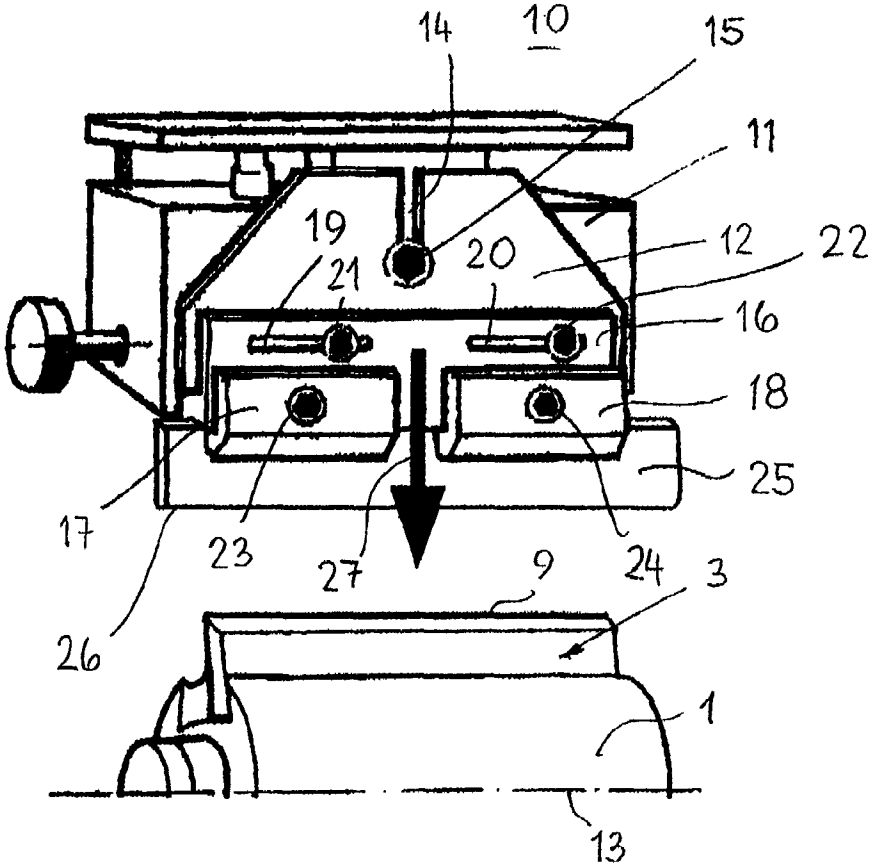
FIG. 1 is a perspective and simplified illustration of the jointing device in a first position of the jointing process.
Figure 6:
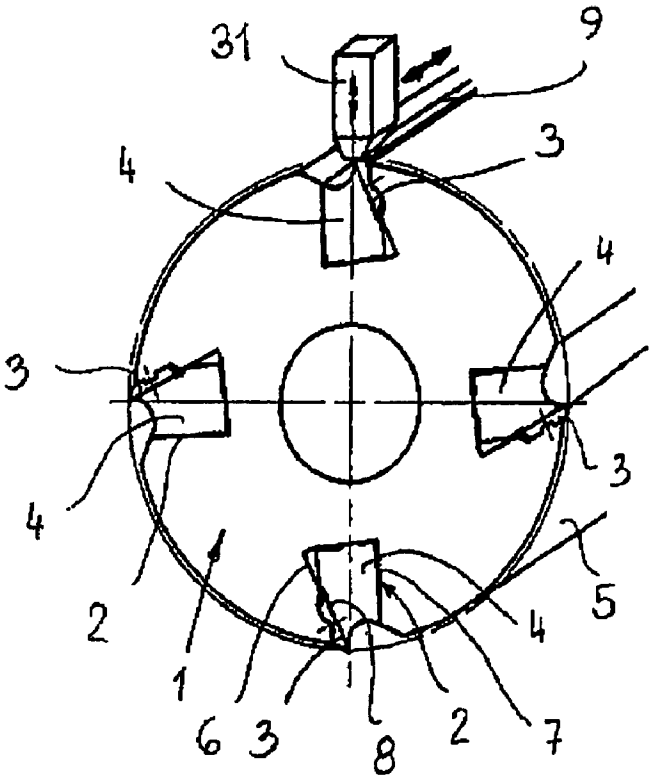
Fig. 6 Prior Art
FIG. 6 is a simplified perspective illustration of a blade head with straight cutting blades with a jointing stone according to the prior art being employed for jointing.

FIG. 1 shows the blade head 1 of a woodworking machine which is fixedly connected on a rotatably driven shaft and is provided about its periphery with receptacles 2 for the cutting blades 3 (FIG. 6). The cutting blades 3 are secured in the receptacles 2, as is known in the art, with clamping wedges 4 or the like. The receptacles 2 have sidewalls 6, 7 converging in the direction of the mantle surface 5 of the cylindrical blade head 1 against which the clamping wedges 4 rest. The cutting blades 3 are seated in a depression 8 in the sidewall 6 and are forced by means of the clamping wedge 4 tightly against the bottom of the depression 8. In addition, the cutting blades 3 can be secured by means of screws which are distributed across the length of the cutting blades 3.

The machine, depending on its configuration, has several such blade heads 1 which are arranged on shafts such that their cutting blades 3 machine different sides of the wood material. For example, a molding machine has a lower horizontal spindle, a vertical right spindle, a vertical left spindle, as well as a top horizontal spindle on which a blade head with corresponding cutting blades 3 is fixedly attached, respectively. For reasons of simplification, the drawings show only one blade head 1.

The cutting blades 3 projecting radially from the blade head 1 have a cutting edge 9 which is straight in the illustrated embodiment.

In order to joint the cutting edge 9, a jointing device 10 is provided which has a housing 11. A preferably plate-shaped support 12 is connected to the housing 11 and is configured to be radially adjusted relative to the axis 13 of the blade head 1. For this purpose, the support 12 is provided with a slot 14 open at the edge of the support 12 and extending perpendicularly to the axis 13. A threaded bolt 15 or the like projects through the slot 14 and secures the support 12 on one sidewall of the housing 11.

On the front side of the support 12, a second support 16 is fastened which has holders 17,18 positioned at a spacing to one another. The support 16 has two slots 19, 20 positioned perpendicularly to the slot 14 of the support 12 through which a threaded bolt 21, 22 or the like projects with which the support 16 is fastened on the support 12. The two holders 17, 18 are fastened with at least one threaded bolt 23, 24 on the support 16 and are provided for securing a jointing stone 25. The jointing stone 25 is longer than the cutting edges 9 of the cutting blades 3 to be jointed and projects with its two ends past the two supports 12, 16. The jointing stone 25 projects in the direction toward the blade head 1 past the holders 17, 18. It can be adjusted axially relative to the cutting blades 3 in that the threaded bolts 21,22 are released and the support 16 is moved parallel to the blade head axis 13 relative to the support 12 into the desired position. Then the threaded bolts 21,22 are again tightened and, in this way, the jointing stone 25 is secured in the desired position.

The jointing stone 25 has a straight and planar jointing surface 26 with which the jointing process to be described in the following is performed. During the jointing process the blade head 1 rotates while the straight jointing stone 25 is advanced with the jointing device 10 radially in the advancing direction 27. The jointing stone 25 is advanced radially until the jointing surface 26 will engage or contact the cutting edges 9 of all the cutting blades 3 of the blade head 1. Now the straight jointing stone 25 is moved axially back and forth (arrow 29 in FIG. 2). The length of the jointing stone 25 is greater than the length of the cutting edge 9 to be jointed. In order to be able to joint the cutting blades 9 of the cutting blade 3 of the rotating blade head 1 according to the described method, only a small stroke of the jointing stone 25 is required. Advantageously, the jointing stone 25 is longer by half the stroke length relative to the cutting edge 9. Accordingly, the jointing stone 25 is in contact with the cutting edge 9 in all axial positions. An exemplary stroke length is approximately 20 mm, i.e., the jointing stone 25 must travel only a minimal stroke length in order to optimally joint the cutting edge 9.

As a result of the axial stroke movement a groove formation on the cutting edge 9, as it occurs during a conventional jointing process, is prevented. Such a groove formation occurs, for example, when the jointing stone 25 on its jointing surface 26 has a nick or a notch. As a result of the axial stroke movement, such a nick, which can also be present on the jointing surface 26, does not result in a groove formation on the cutting edge 9. Since the jointing surface 26 of the jointing stone 25 is in contact with the cutting blade 3 over the entire length of the cutting edge 9 during the jointing process, the wear of the jointing stone 25 is minimal because the large jointing surface 26 is employed for each jointing process.

Figure 3:
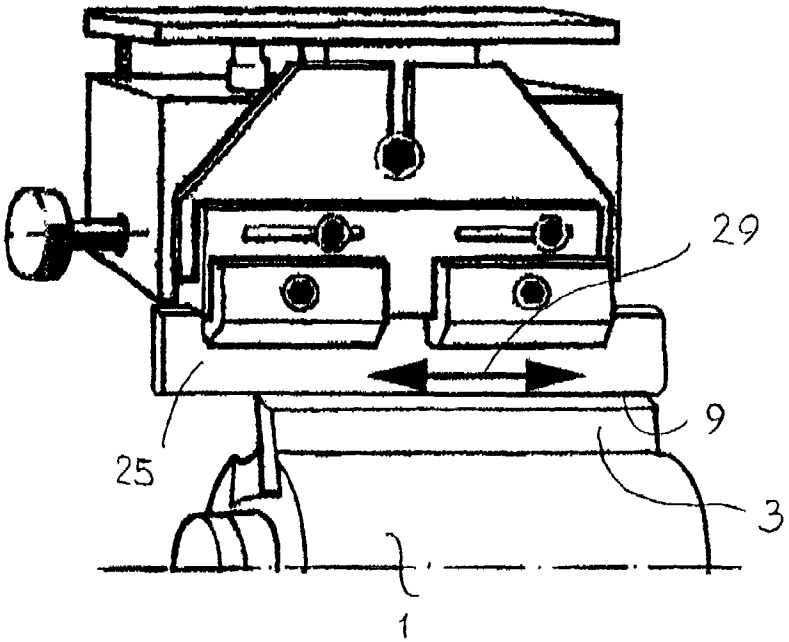
FIG. 3 is a perspective and simplified illustration of the jointing device in a third position of the jointing process.

FIG. 2 shows the position of the jointing stone 25 directly after the radial advancement 27 and before an axial stroke is carried out. In FIG. 3, the jointing stone 25 has been moved axially to the left in the direction of arrow 29 and is in contact with the cutting edge 9 of the cutting blade 3. The axial stroke is carried out such that the jointing stone 25 in the end position projects in the stroke direction still slightly with its rearward end past the cutting blade 3.

Subsequently, the jointing stone 25 is moved in the reverse direction (FIG. 4) wherein the jointing surface 26 is again in contact with the cutting edge 9 of the cutting blade 3. During the jointing process, the blade head 1, of course, rotates about its axis so that the cutting edge 9 of all the cutting blades 3 of the blade head 1 are jointed in the described way. The rotational speed of the blade head 1 is significantly greater than the axial stroke speed of the jointing stone 25 so that a groove formation on the cutting edge 9 of the cutting blade 3 is reliably prevented and the cutting edges 9 of all cutting blades 3 of the blade head 1 can be jointed precisely.

In the described way, the straight jointing stone 25 oscillates without radial advancement in the axial direction. Depending on the state of the cutting blades 3 to be jointed, more or fewer stroke movements are carried out. In some cases, a single axial stroke is sufficient in order to joint all of the cutting blades 3 of the blade head 1 sufficiently.

Figure 4:
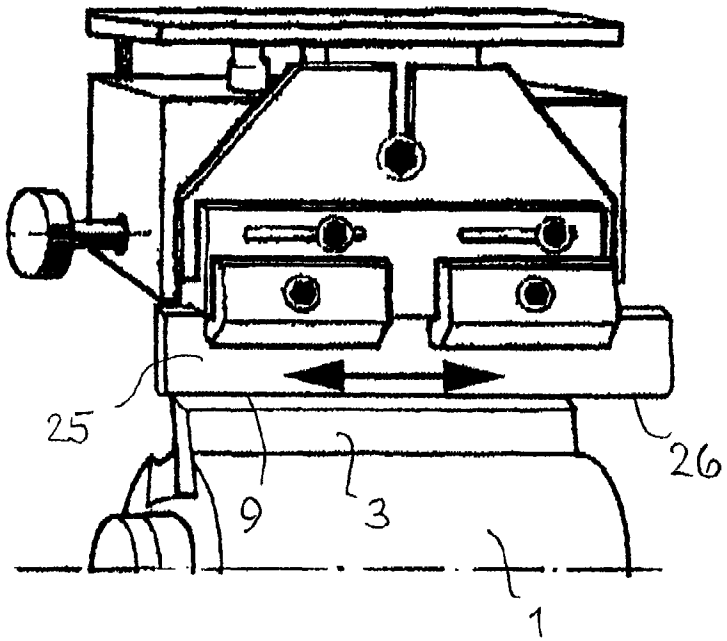
FIG. 4 is a perspective and simplified illustration of the jointing device in a fourth position of the jointing process.

In the stroke movement according to FIG. 4, the jointing stone 25 is axially moved by means of the jointing device 10 to such an extent that the rearward end of the jointing stone 25 still projects in the stroke direction slightly past the cutting blade 3 (FIG. 4).

Figure 5:
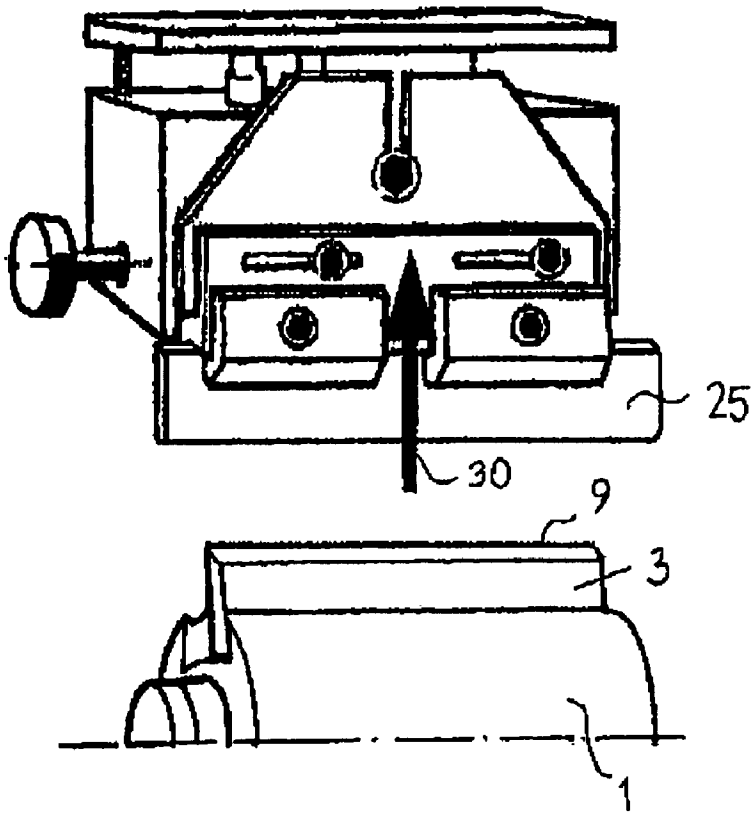
FIG. 5 is a perspective and simplified illustration of the jointing device in a fifth position of the jointing process.

Advantageously, the jointing stone 25 is again axially moved in the described way into the center position according to FIG. 2 and then lifted radially in the lifting direction 30 (FIG. 5) so that the jointing stone 25 is lifted off the cutting blades 3 of the blade head 1.

The jointing device 10, of course, can also be radially retracted at the reversing point of the axial stroke. Also, it is possible to lift the jointing device 10 off the jointing blades 3 in any desired axial stroke position.

With the described method not only a groove formation is prevented and the wear of the jointing stone 25 is reduced, but the cutting edges 9 are also significantly improved after completion of the jointing process. Microscopic images of the cutting edge 9 after the jointing process have shown that the cutting edge 9 is microscopically smooth. This results in a significantly improved surface quality of the workpieces machined with the cutting blades 3 and in a high service life of the tool as a result of the minimal pre-damage and the thus resulting minimal tendency for the formation of built-up edges or break-away cutting edges. The smooth cutting edge 9 is achieved by the axial stroke movement of the jointing stone 25 without radial advancement.

In the next jointing process, the jointing stone 25 is again radially advanced, for example, within a magnitude of 1.5 mm to 2/100 mm.

When the cutting edge 9 already has a groove, this groove in the cutting edge 9 of the cutting blade 3 can be simply removed with the described jointing process.

Since the axial movement of the jointing stone 25 must not be carried out across the entire length of the cutting edge 9, but only across a minimal axial stroke length which is, for example, only approximately 20 mm, the jointing device 10 can be configured constructively in a very simple way.

Figure 7:
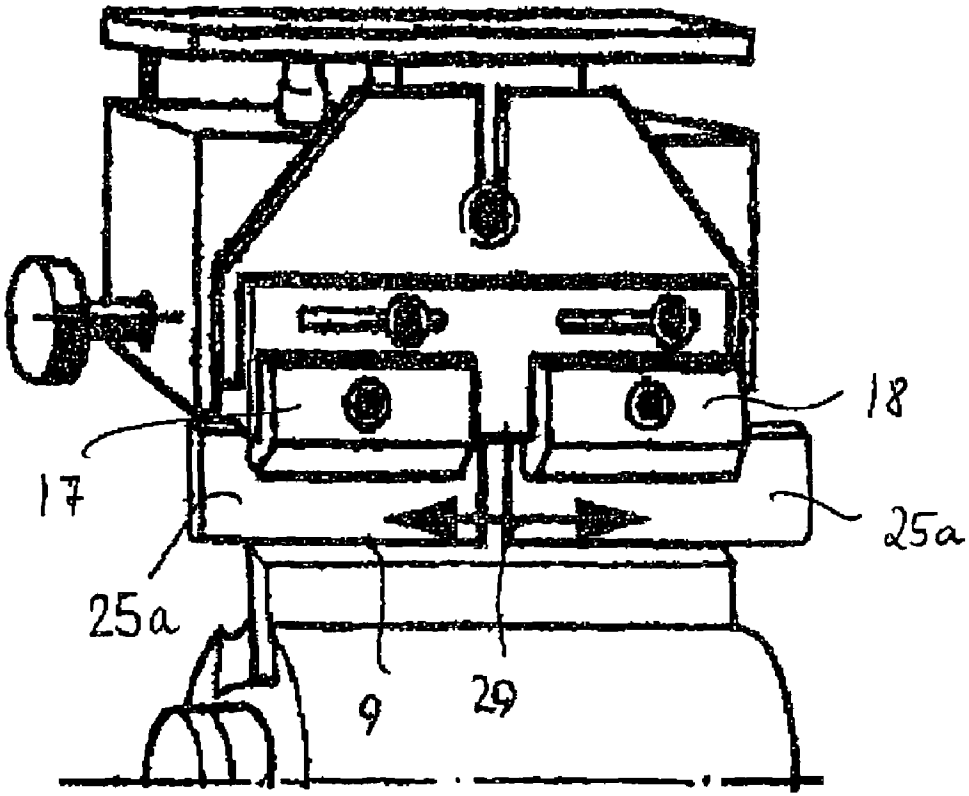
FIG. 7 shows a jointing stone comprised of two jointing stone members.

Instead of the individual straight jointing stone 25, it is also possible to provide two or more jointing stone members 25*a* (see FIG. 7) positioned at a minimal axial spacing, i.e., minimal spacing in the stroke direction, relative to one another which are then secured by holders 17, 18, respectively. The two jointing stone members are then advantageously arranged on the jointing device 10 such that, in the center position relative to the cutting edge 9, their ends facing away from one another project axially past the cutting edge 9. The axial stroke of these two jointing stone members after radial advancement is then selected such that it is greater than the spacing between the two jointing stone members. This ensures that the two jointing stone members have overlapping machining areas. Moreover, the jointing stone members are advantageously so long that in the end position of the respective axial stroke they still project axially with their trailing end in the stroke direction past the cutting edge 9.

Instead of the straight jointing stone 25, a profile jointing stone can be used in the same jointing device 10. During the jointing process, an axial stroke movement is however not possible in this case.

In the described embodiment, the jointing device 10 is seated on a compound slide rest which is not illustrate in order to simplify the drawing. With it, the jointing device 10 can be moved radially and axially in the described way. Instead of the compound slide rest, it is also possible, for example, to radially move the support 12 relative to the housing 11 and to axially move the support 16 relative to the support 12.

The jointing process can be carried out, in deviation from the illustrated and described embodiment, also such that the radial and axial movements are assigned to the blade head 1 or the spindle supporting it. Also, it is possible to assign the radial and axial movements to the jointing stone 25 and the blade head 1, respectively.

While specific embodiments of the invention have been shown and described in detail to illustrate the inventive principles, it will be understood that the invention may be embodied otherwise without departing from such principles.

What is claimed is:

1. A method of jointing a cutting edge of at least two cutting blades of a rotating tool, the method comprising the steps of:

rotating the tool;

performing a radial advancing movement between the rotating tool and at least one straight jointing stone so that the at least one jointing stone engages all cutting edges of the at least two cutting blades;

performing an oscillating movement of the at least one jointing stone in a longitudinal direction of the cutting edges of the cutting blades of the rotating tool by carrying out several relative strokes between the at least one jointing stone and the cutting edges of the cutting blades of the rotating tool, wherein the stroke length is multiple times shorter than a length of the cutting edges of the at least two cutting blades;

wherein the at least one jointing stone always engages an entire length of the cutting edge.

2. The method according to claim 1, wherein the step of performing an oscillating movement is carried out without radially advancing the at least one jointing stone.

3. A method of jointing a cutting edge of at least two cutting blades of a rotating tool, the method comprising the steps of:

rotating the tool;

performing a radial advancing movement between the rotating tool and at least one straight jointing stone so that the at least one jointing stone engages all cutting edges of the at least two cutting blades;

performing an oscillating movement of the at least one jointing stone in a longitudinal direction of the cutting edges of the cutting blades of the rotating tool by carrying out several relative strokes between the at least one jointing stone and the cutting edges of the cutting blades of the rotating tool, wherein the stroke length is multiple times shorter than a length of the cutting edges of the at least two cutting blades;

wherein the at least one jointing stone is longer than the cutting edge plus the length of the relative stroke.

4. The method according to claim 3, wherein the step of performing an oscillating movement is carried out without radially advancing the at least one jointing stone.

* * * * *